US006888436B1

(12) United States Patent
Yagasaki

(10) Patent No.: US 6,888,436 B1
(45) Date of Patent: May 3, 2005

(54) ISOLATION TRANSFORMERS

(75) Inventor: Akihiko Yagasaki, Tokyo (JP)

(73) Assignee: Denkenseiki Re. In. Corporation, Tokyo (JP)

( * ) Notice: Subject to any disclaimer, the term of this patent is extended or adjusted under 35 U.S.C. 154(b) by 453 days.

(21) Appl. No.: 09/597,236

(22) Filed: Jun. 20, 2000

(30) Foreign Application Priority Data

Sep. 28, 1999 (JP) ..... 11-273755

(51) Int. Cl.[7] ..... H01F 27/02
(52) U.S. Cl. ..... 336/84 C; 336/69; 336/84 R
(58) Field of Search ..... 336/61, 69, 84 R, 336/84 C, 180–184, 70

(56) References Cited

U.S. PATENT DOCUMENTS

| | | | | | |
|---|---|---|---|---|---|
| 343,602 | A | * | 6/1886 | Pfannkuche | 336/84 C |
| 1,548,022 | A | * | 8/1925 | Casper et al. | 336/84 R |
| 2,008,859 | A | * | 7/1935 | Ganz | 338/84 C |
| 2,592,817 | A | * | 4/1952 | McKechnie | 336/84 C |
| 2,817,066 | A | * | 12/1957 | Scarpa | 336/84 C |
| 3,416,111 | A | * | 12/1968 | Bogner | 336/69 |
| 3,638,155 | A | * | 1/1972 | Combs | 336/69 |
| 4,089,049 | A | * | 5/1978 | Suzuki et al. | 363/17 |
| 4,356,468 | A | * | 10/1982 | Van Laar | 336/69 |
| 4,379,999 | A | * | 4/1983 | Kimura et al. | 336/84 C |
| 4,449,111 | A | * | 5/1984 | Nakajima | 336/206 |
| 4,484,171 | A | * | 11/1984 | McLoughlin | 336/84 C |
| 4,518,941 | A | * | 5/1985 | Harada | 336/69 |
| 4,660,014 | A | * | 4/1987 | Wenaas et al. | 336/84 C |
| 4,926,111 | A | * | 5/1990 | Lungu | 336/69 |

FOREIGN PATENT DOCUMENTS

| | | | |
|---|---|---|---|
| JP | 3-64009 | * | 8/1989 |
| JP | 264256 | | 8/1997 |

OTHER PUBLICATIONS

Akihiko Yagasaki "Highly Improved Performance of a Noise Isolation Transformer by a Thin–Film Short–Circuit Ring," IEEE Transactions on Electromagnetic Compatibility, vol. 41, No. 3, Aug. 1999, pp. 246–250.

* cited by examiner

*Primary Examiner*—Tuyen T Nguyen
(74) *Attorney, Agent, or Firm*—Venable LLP; Thomas G. Wiseman; Jeffrey W. Gluck

(57) ABSTRACT

The issue to be resolved by the present invention is to provide isolation transformers with high noise attenuation rates as well as high reliability, in the high-frequency region above a few MHz, by sufficiently suppressing the amplitudes of noise attenuation characteristic curves, which are irregular, saw-tooth shaped waves with crests and troughs of various sizes, of multi-layer, multi-winding transformers.

An isolation transformer comprised by a multi-layer, multi-winding primary coil 1, a multi-layer, multi-winding secondary coil 2, and a core that forms a magnetic path between the aforementioned primary coil and the aforementioned secondary coil, functions as an isolation transformer to resolve the aforementioned issue by changing the coil layers of one or both of the coils formed by winding an insulated, covered, copper-wire 5 to a multi-layer, multi-winding coil, into which a number of short-circuit rings 4 made of conducting films are inserted and layered.

The planer configuration of the aforementioned conducting short-circuit rings 4 is made approximately identical to that of the neighboring coil-layers, and their thickness is made approximately identical to or less than the skin depth of the induced current generated by the skin effect in the high-frequency region, in which resonances should be suppressed.

12 Claims, 6 Drawing Sheets

【FIG.1】
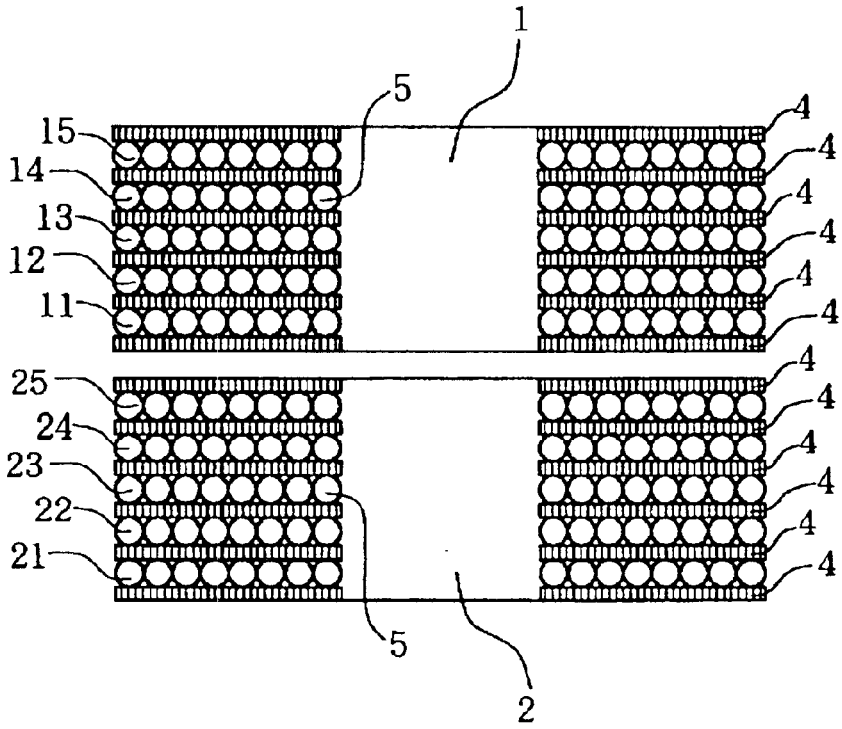
【FIG.2】
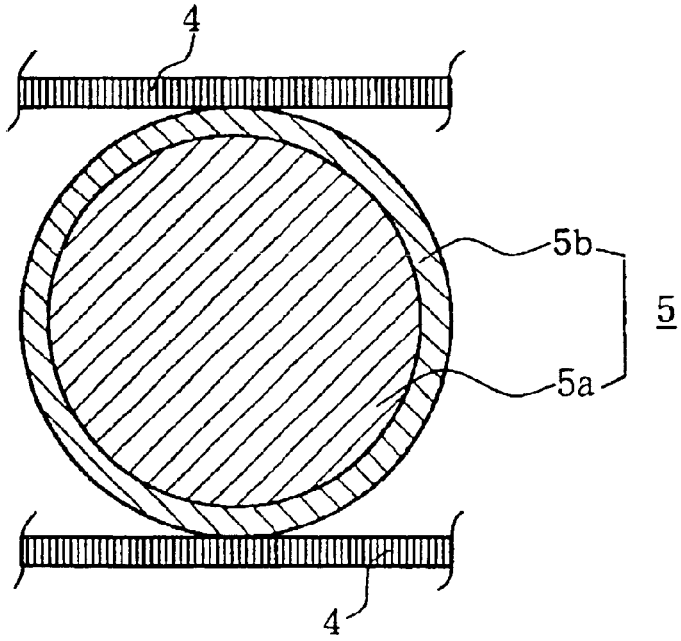

【FIG.3】
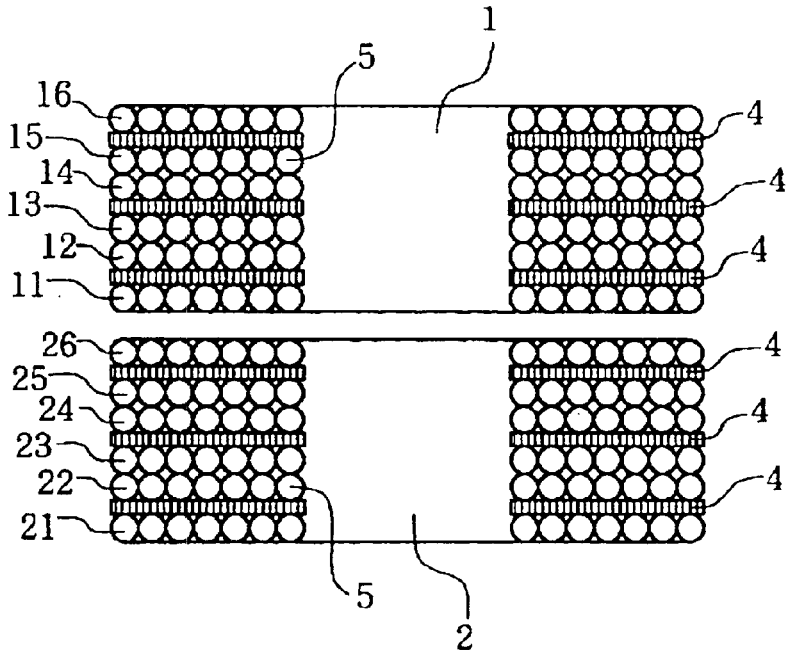
【FIG.4】
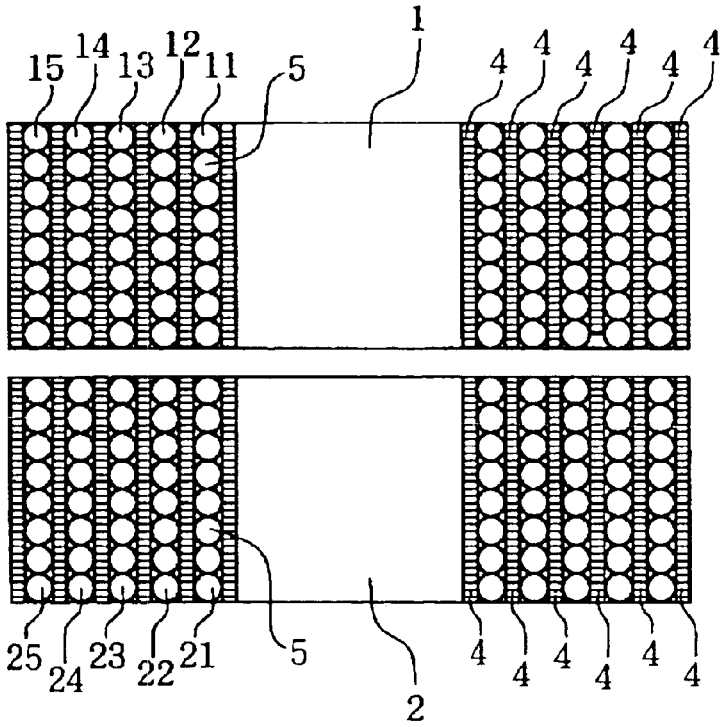

【FIG.5】
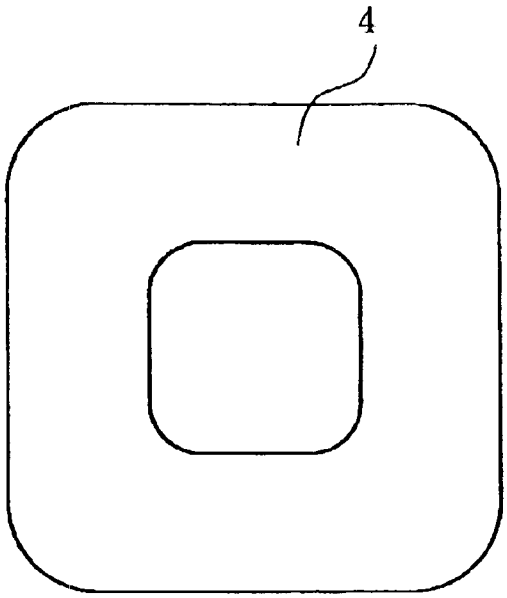
【FIG.6】
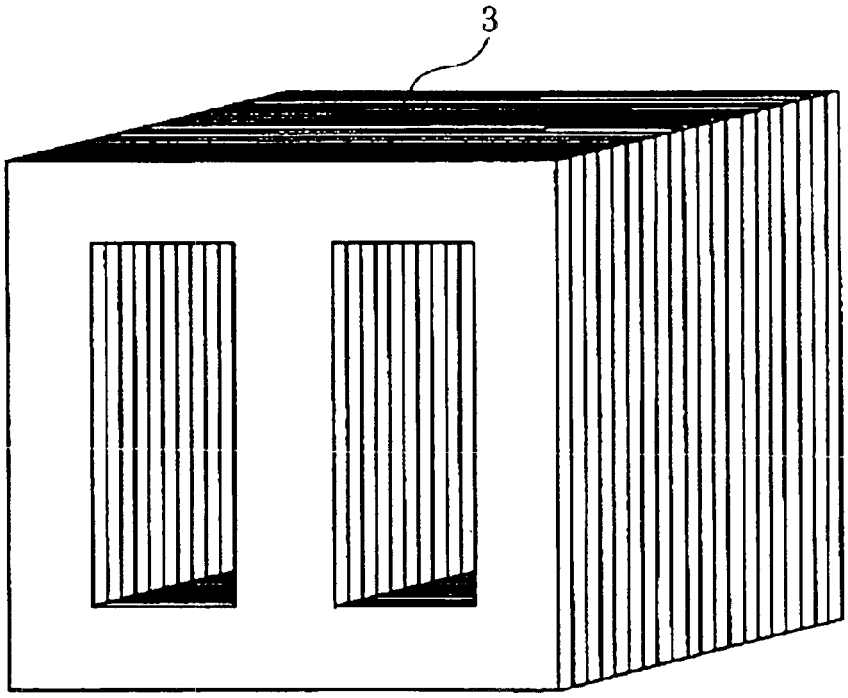

【FIG.7】
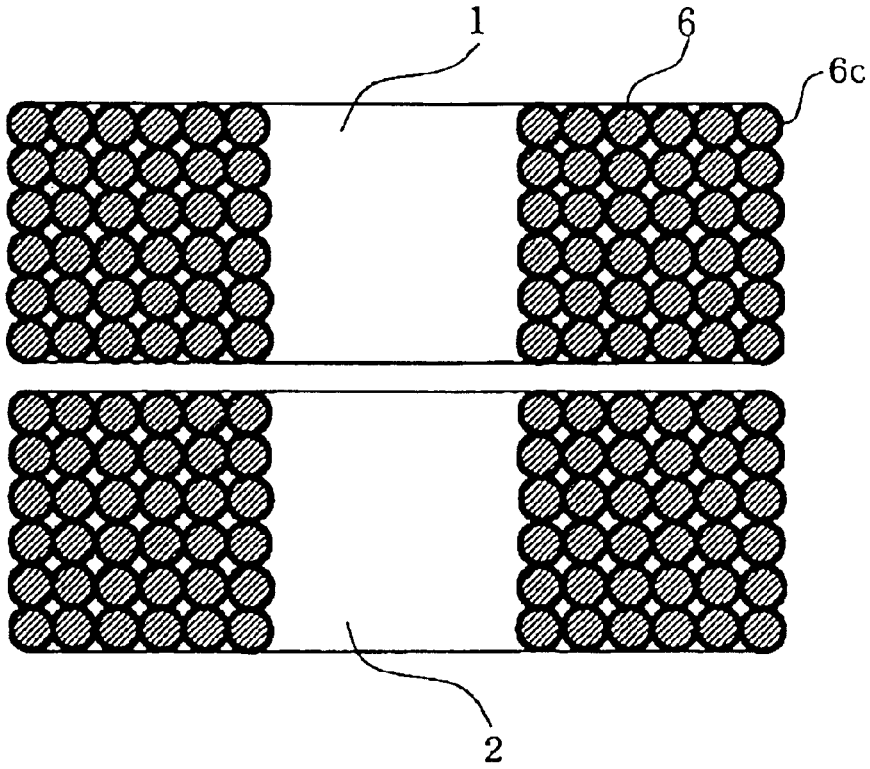
【FIG.8】
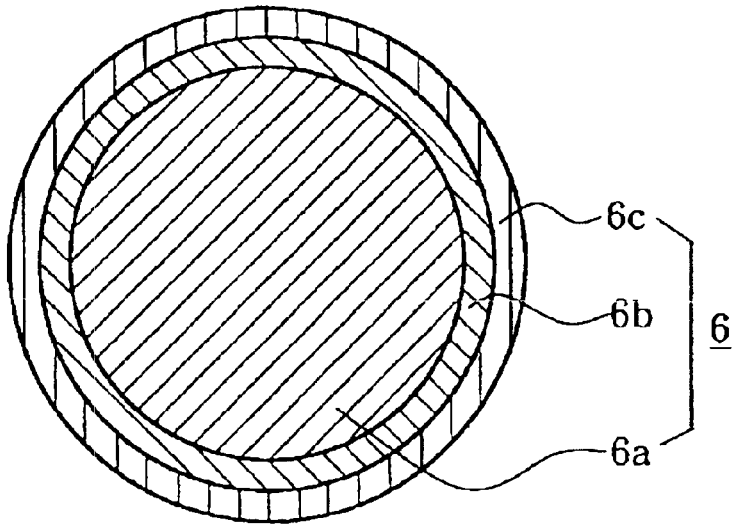

【FIG.9】
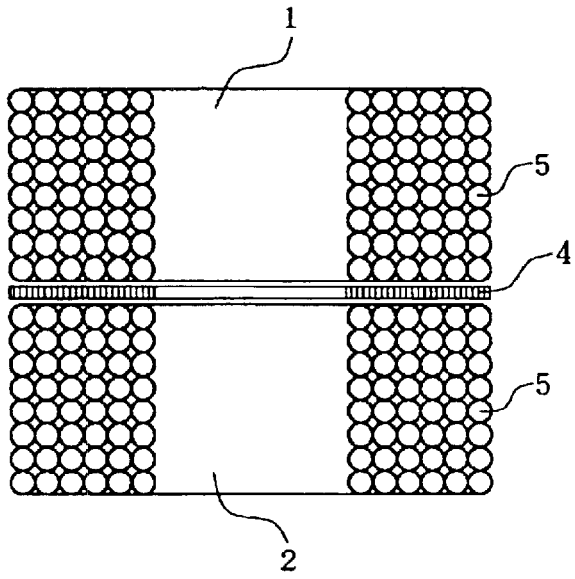
【FIG.10】
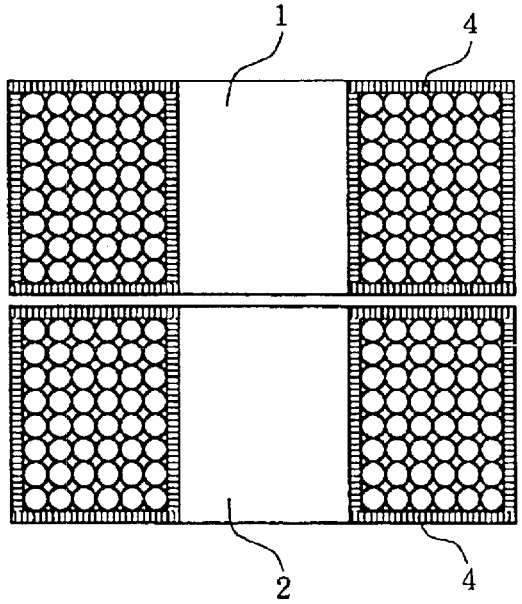
PRIOR ART

【FIG.11】
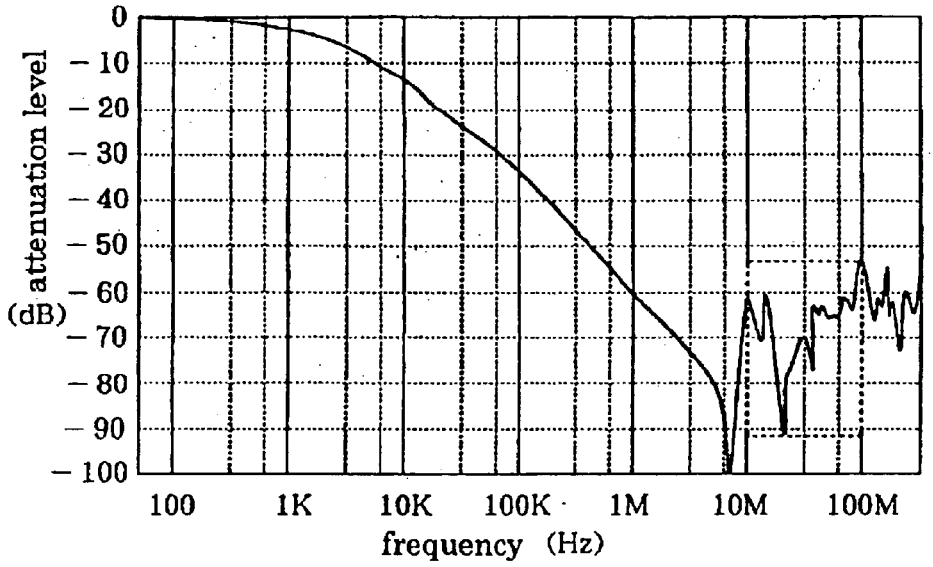
【FIG.12】
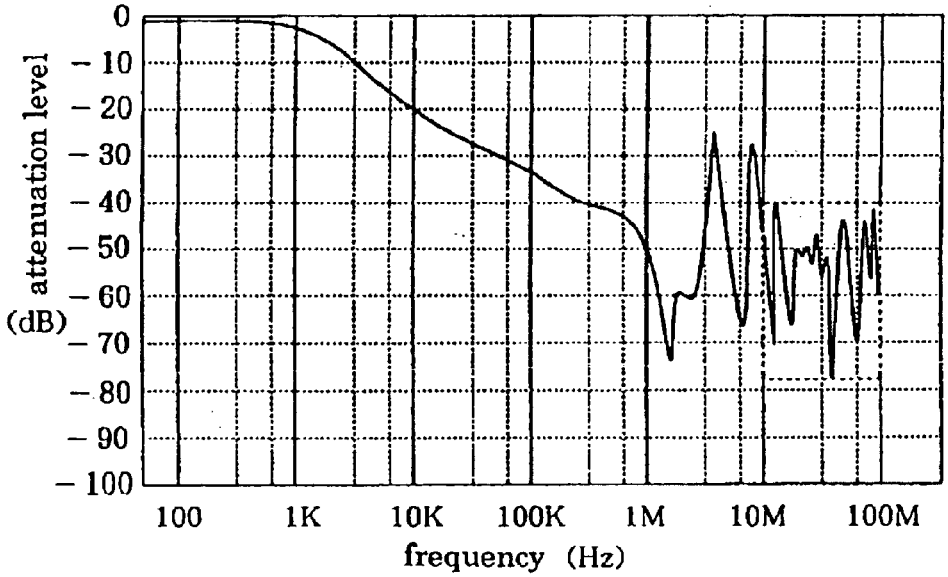
PRIOR ART

ISOLATION TRANSFORMERS

BACKGROUND OF THE INVENTION

This invention is related to isolation transformers that suppress high-frequency electromagnetic noise (hereafter called noise) transmitted through power transmission lines and/or signal transmission lines.

Micro-computers are being used in various fields such as information, communication, and other industries in addition to daily life etc. This is due to down-sizing, lower prices, and higher reliability of micro-computers driven by the continuous advancement of integrated circuits. However, integrated circuits are controlled by extremely small electric energy, and therefore, are subject to errors and damages caused by some noise transmitted from external sources. Such events will eventually lead to various inconveniences and/or accidents owing to malfunctioning or stopping of various equipment and devices that contain integrated circuits and of systems using them. Consequently, protection of electronic devices and equipment that contain densely packed and complicated circuits from noise-related troubles have become an urgent issue.

For suppression of noise-related troubles isolation transformers of electromagnetic-shield type have been used. The isolation transformers of electromagnetic-shield type have primary- and secondary coils isolated by approximately 20 $\mu$m-thick aluminum foils. The isolation transformers of electromagnetic-shield type have such attenuation characteristics of normal-mode noise as depicted in FIG. 11. Namely, in the frequency range of several hundred Hz to 1 MHz the attenuation increases generally mildly with the frequency to −50 dB. In the range from 1 MHz to 100 MHz it takes the form of an irregular saw-tooth wave, which is comprised by troughs and crests of various sizes between the maximum of −78 dB and the minimum of −24 dB.

The noise attenuation characteristic that occurs in the high-frequency region above a few MHz, and takes the form of an irregular saw-tooth wave, which is comprised by troughs and crests of various sizes is caused by stray capacitance appearing uniquely in each transformer; its origin can be traced to the multi-layer, multi-winding coils having numerous, irregular resonance circuits caused by complicated combinations of infinitesimally different inter-layer and inter-winding distributed capacitance as well as leakage inductances. Components with extremely complicated combinations such as multi-layer, multi-winding coils in transformers thus have random and complicated noise attenuation characteristics; as the crests have extremely low attenuation, this scheme cannot provide highly reliable isolation transformers. In order to improve the reliability of isolation transformers it is necessary to increase the attenuation in the high frequency region exceeding a few MHz and to fully decrease each amplitude of the saw-tooth wave comprised by troughs and crests of various sizes, suppressing the crests. As the irregular curves of the attenuation characteristic is unique to each transformer, the ideal suppression mechanism ought to commonly and effectively apply to any transformer. However, it has been impossible for the isolation transformers of electromagnetic-shield type to satisfy this condition.

Therefore, this inventor has developed two types of isolation transformers to resolve the aforementioned issue confronting the isolation transformers of electromagnetic-shield type: One of them was made public in the Japanese Patent No. 2,645,256, and, as shown in FIG. 10, it is an isolation transformer, which is characterized by shielding entirely both primary- and secondary coils by short-circuit rings 4 made of conducting thin films of thickness of 0.5~100 $\mu$m.

Another is the type published in IEEE (U.S. Institute of Electrical and Electronics Engineers) Transactions on Electromagnetic Compatibility, Vol. 41, No. 3, August 1999. As shown in FIG. 9, this is an isolation transformer characterized by positioning in the vicinity of, or more specifically, in-between primary- and secondary coils a short-circuit ring 4 made of a conducting thin film, which has a thickness of approximately 7 $\mu$m or less (hereafter abbreviated as isolation transformer of short-circuit-ring type). As shown in FIG. 6 as an example, the core that forms a magnetic path between the primary coil 1 and the secondary coil 2, is manufactured by stacking together pieces of type E core and pieces of type I core of specified dimensions to specified thickness after stamping them out of an isotropic silicon steel sheet of thickness of 0.5 mm. Furthermore, the short-circuit ring 4 of conducting thin film is fabricated, as shown in FIG. 5 for an example, by cutting a ring, which is approximately as thick as the primary coil 1 and secondary coil 2, out of a rolled aluminum foil of thickness of 7 $\mu$m and by laminating it to a durable polyester film of thickness of 50 $\mu$m.

This short-circuit ring 4 made of metallic thin film with a large surface area functions as the tertiary coil connected to the primary- and secondary coils, respectively. Through this short-circuit ring 4 of conducting thin film flows the current induced by fundamental wave current flowing through the primary coil, its higher harmonics, and high-frequency noise from external sources. In this case, as the high-frequency components flow essentially at the surface of the conductor only owing to the skin effect, they flow around the short-circuit ring, even if the ring is thin. Therefore, being effectively attenuated by the resistivity of the short-circuit ring, it is hard for the high-frequency components to flow from the primary coil to the secondary coil. At the same time, since the resistivity of the short-circuit ring functions as a resistance commonly inserted to all of the resonance circuits, which are distributed in the form of a number of infinitesimally small irregularly present resonance circuits due to complex combinations of capacitance and leakage inductances irregularly distributed in the coils, the resistivity of the short-circuit ring has the effect of dramatically reducing the amplitudes of resonances. To sum up, in the isolation transformers of short-circuit ring, a short-circuit ring of conducting thin film or a short-circuit ring of conducting thin film laminated with a plastic film is used and the surface area of the aforementioned short-circuit rings is made approximately as large as that of the neighboring coil layers, and their thickness is made approximately identical to or less than the skin depth of the induced current generated by the skin effect in the high-frequency region, in which resonances should be suppressed.

Meanwhile, the currents induced by the fundamental wave, which are low-frequency components, are reduced in proportion to the cross sectional area of the conducting thin film of the short-circuit ring 4. However, as the short-circuit ring is made of a thin film of thickness of 7 $\mu$m, its cross section is small albeit its width. Therefore, the induced currents of fundamental-wave component that flows through the short-circuit ring is extremely small. As a consequence, by positioning this short-circuit ring 4 with a wide surface area in the vicinity of the primary- and secondary coils, respectively, an isolation transformer of short-circuit-ring type, which can eliminate or filter high-frequency noise, while keeping the loss of the fundamental-wave negligibly small, is provided.

Presented in FIG. 11 is an example of attenuation characteristics for the normal-mode noise of the isolation transformer of short-circuit ring type depicted in FIG. 9. Namely, in the range from a few hundred Hz to 1 MHz the attenuation increases generally mildly with the frequency to −60 dB, while in the range from 1 MHz to 100 MHz it has the form of an irregular saw-tooth wave, which is comprised by crests and troughs of various sizes between the maximum of −100 dB and the minimum of −53 dB. Furthermore, in the range from 100 MHz to 300 MHz it has the form of an irregular saw-tooth wave, which is comprised by crests and troughs of various sizes between the maximum of −72 dB and the minimum of −50 dB.

As is evident in FIG. 11, the attenuation characteristic curve of the isolation transformer of short-circuit ring type has a relatively flat portion with steep crests and troughs replaced with crests and troughs of smaller amplitudes. In comparison with isolation transformers of electromagnetic-shield type the isolation transformers of short-circuit-ring type show considerable improvements concerning the attenuation characteristic of normal-mode noise in the high-frequency region over 1 MHz. More specifically, as shown in FIG. 12, the isolation transformer of electromagnetic-shield type has the lowest attenuation of −24 dB, while as shown in FIG. 11 the isolation transformer of short-circuit-ring type has that of −53 dB, showing an outstanding improvement of 29 dB. The same trend exists for the highest points of attenuation, which is −78 dB for the isolation transformer of electromagnetic-shield type, while −100 dB for the isolation transformer of short-circuit-ring type, showing another outstanding improvement of 22 dB.

Furthermore, in the high-frequency range over 10 MHz considerable improvements are observed in the normal-noise characteristic. Namely, as evident in the region encompassed by thick dotted lines, the normal-mode attenuation characteristic in the range from 10 MHz to 100 MHz of the isolation transformer of the electromagnetic-shield type has the highest point of −78 dB and the lowest point of 40 dB, while that of the isolation transformer of the short-circuit-ring type has the highest point of −91 dB and the lowest point of 53 dB, showing considerable improvements of 13 dB at both the highest and lowest attenuation points.

Though not illustrated, the same trend exists for common-mode noise; isolation transformers of short-circuit-ring type show considerable improvements over isolation transformers of electromagnetic-shield type in the high-frequency region above a few MHz.

Though inside such components having extremely complicated combinations as multi-layer, multi-winding coils, there exist a number of resonance circuits caused by complicated combinations of infinitesimally different inter-layer and inter-winding distributed capacitance as well as leakage inductances, inside isolation transformers of short-circuit-ring type the effects of stray capacitance due to such resonance circuits are evidently reduced. Moreover, as in addition to increasing the attenuation rates in the high-frequency range above a few MHz the amplitudes of the irregular saw-tooth shaped waves with crests and troughs of various sizes were suppressed to the lowest possible level, the reliability of isolation transformers of the short-circuit-ring type has been considerably improved.

However, as evidently shown in FIG. 11, the suppression of amplitudes of the characteristic curve for the attenuation rate of normal-mode noise with irregular saw-tooth shaped waves with crests and troughs of various sizes in the high-frequency region above a few MHz is not sufficient yet. Therefore, there still remains a question with regard to the reliability of the conventional isolation transformers of short-circuit-ring type with a wide short-circuit ring of conducting thin film covering each surface of primary- and secondary coils and of the isolation transformers of short-circuit-ring type with a wide short-circuit ring of a conducting thin film positioned between and in the vicinity of primary- and secondary coils.

BRIEF SUMMARY OF THE INVENTION

The issue to be resolved by the present invention is to provide isolation transformers with high noise attenuation rates as well as high reliability by sufficiently suppressing the amplitudes of noise attenuation characteristic curves, which are irregular, saw-tooth shaped waves with crests and troughs of various sizes, of multi-layer, multi-winding transformers.

An isolation transformer comprised by a multi-layer, multi-winding primary coil, a multi-layer, multi-winding secondary coil, and a core that forms a magnetic path between the aforementioned primary coil and the aforementioned secondary coil, functions as an isolation transformer to resolve the aforementioned issue by changing the coil layers of one or both of the coils formed by winding an insulated, covered, copper-wire to a multi-layer, multi-winding coil, into which a number of short-circuit rings made of conducting films are inserted and layered.

The planar configuration of the aforementioned conducting short-circuit rings is made approximately identical to that of the neighboring coil-layers, and their thickness is made approximately identical to or less than the skin depth of the induced current generated by the skin effect in the high-frequency region, in which resonances should be suppressed. The aforementioned short-circuit ring is inserted in between every coil layer or in-between selected coil layers.

As the aforementioned short-circuit ring, a short-circuit ring of conducting thin film or a short-circuit ring of conducting thin film laminated with a plastic film is used.

The aforementioned short-circuit ring has a thickness of 7 $\mu$m or less.

Also, an isolation transformer comprised by a multi-layer, multi-winding primary coil, a multi-layer, multi-winding secondary coil, and a core that forms a magnetic path between the aforementioned primary coil and the aforementioned secondary coil functions as an isolation transformer to resolve the aforementioned issue by changing the coil layers of one or both of the coils formed by winding spirally an insulated, covered, copper-wire to a multi-layer, multi-winding coil, into which a number of short-circuit rings made of conducting film are inserted and layered.

The planar configuration of the aforementioned conducting short-circuit rings is made approximately identical to that of the neighboring coil-layers, and its thickness is made approximately identical to or less than the skin depth of the induced current generated by the skin effect in the high-frequency region, in which resonances should be suppressed.

The aforementioned short-circuit rings are inserted into every coil layer or into selected coil layers. As the aforementioned short-circuit rings, short-circuit rings of conducting thin film or short-circuit rings of conducting thin film laminated with a plastic films are used.

The aforementioned short-circuit rings have a thickness of 7 $\mu$m or less.

Moreover, an isolation transformer comprised by a multi-layer, multi-winding primary coil, a multi-layer, multi-winding secondary coil, and a core that forms a magnetic path between the aforementioned primary coil and the aforementioned secondary coil functions as an isolation transformer to resolve the aforementioned issue by changing the coil layers of one or both of the coils formed by winding cylindrically an insulated, covered, copper-wire to a multi-layer, multi-winding coil, into which a number of short-circuit rings made of conducting film are inserted and layered.

Furthermore, the inner surface of the aforementioned cylindrical short-circuit rings is made approximately identical to the outer surface of the neighboring coil, and their thickness is made approximately identical to or less than the skin depth of the induced current generated by the skin effect in the high-frequency region, in which resonances should be suppressed.

The aforementioned short-circuit rings are inserted in-between every coil layer or in-between selected coil layers.

As the aforementioned short-circuit rings, short-circuit rings of conducting thin film or short-circuit rings of conducting thin films laminated with plastic films are used. The aforementioned short-circuit rings have a thickness of 7 $\mu$m or less.

Furthermore, an isolation transformer comprised by a multi-layer, multi-winding primary coil, a multi-layer, multi-winding secondary coil, and a core that forms a magnetic path between the aforementioned primary coil and the aforementioned secondary coil functions as an isolation transformer by changing the coil layers of one or both of the coils formed by winding an insulated, covered, copper-wire to a multi-layer, multi-winding coil.

Each layer of the multi-layer, multi-winding coils are formed by winding an insulated, covered, copper-wire, the surface of which is further covered with a conducting film that is made approximately as thick as or less thicker than the skin depth of the induced current generated by the skin effect in the high-frequency region, where resonances should be suppressed.

The aforementioned conducting thin films have a thickness of 7 $\mu$m or less.

BRIEF DESCRIPTION OF THE DRAWINGS

FIG. 1 is a cross section view of the isolation transformer in the first embodiment.

FIG. 2 is a cross section view of magnified part of the isolation transformer in the first embodiment shown in FIG. 1.

FIG. 3 is a cross section view of the isolation transformer of a modification in the first embodiment.

FIG. 4 is a cross section of the isolation transformer of another modification in the first embodiment.

FIG. 5 is a plan view of an example of circular, short-circuit ring of conducting thin film.

FIG. 6 is a oblique view of an example of the core.

FIG. 7 is a cross section of the isolation transformer in the second embodiment of the present invention.

FIG. 8 is a cross section view of magnified part of the isolation transformer in the second embodiment shown in FIG. 7.

FIG. 9 is a cross section of an example of existing isolation transformer of short-circuit ring.

FIG. 10 is a cross section of another example of isolation transformer of short-circuit ring type.

FIG. 11 shows a characteristic curve of attenuation rate for normal mode noise of a isolation transformer of short-circuit ring type.

FIG. 12 shows a characteristic curve of attenuation rate for normal mode noise of a isolation transformer of electromagnetic-shield type.

DETAILED DESCRIPTION OF THE INVENTION

FIG. 1 depicts a cross section of an isolation transformer of the short-circuit-ring type, which is the first embodiment of the present invention with its bobbin and core omitted and with much reduced numbers of windings and layers for easier comprehension. FIG. 2 depicts a magnified part of FIG. 1. The primary coil is a ring-type coil, in which an insulated, covered, copper-wire 5 was wound with many (N1) layers and many (MI) windings. Likewise, the secondary coil is also a ring-type coil, in which an insulated, covered, copper-wire 5 was wound with many (N2) layers and many (M2) windings. The insulated, covered, copper-wire 5 is a general one with an insulated cover 5*b* such as enamel placed over a copper-wire 5*a*.

For example, a transformer with output 10VA for fundamental wave with voltage 22V has 156 as M1, 166 as M2 as well as 13 as N1 and 14 as N2, respectively.

As shown in FIG. 6, the core that forms a magnetic path between the primary coil 1 and the secondary coil 2, is a general one manufactured by stacking together of pieces of type E core and pieces of type I core of specified dimensions to specified thickness after stamping them out of an isotropic silicon steel sheet of thickness of 0.5 mm.

The short-circuit ring 4 of conducting thin film is fabricated, as shown in FIG. 5 as an example, by cutting a ring, which is approximately as thick as the primary coil 1 and the secondary coil 2, out of a rolled aluminum foil of thickness of 7 U m and by laminating it to a durable polyester film of thickness of 50 $\mu$m. This is fundamentally the same as the ones used in existing isolation transformers of short-circuit-ring type shown in FIG. 9.

In the first embodiment a short-circuit ring 4 of conducting thin film is positioned between each coil layer of each coil. Namely, in the primary coil 10, which is comprised by five coil layers 11, 12, 13, 14, and 15, a short-circuit ring 4 of conducting thin film is inserted in-between all the coil layers, and a short-circuit ring 4 of conducting thin film is positioned under the coil layer 11 as well as on the coil layer 15. Likewise, in the secondary coil 20, which is comprised by five coil layers 21, 22, 23, 24, and 25, a short-circuit ring 4 of conducting thin film is inserted in-between all the coil layers, and a short-circuit ring 4 of conducting thin film is positioned under the coil layer 21 as well as on the coil layer 25. Therefore, in the isolation transformer of the first embodiment there are in all twelve short-circuit rings 4 of conducting thin film used with six of them positioned in the primary coil and six others in the secondary coil.

The method to position a short-circuit ring 4 made of a planar, ring-shaped, conducting thin film into the space between coil layers in an isolation transformer of short-circuit-ring type shown in FIG. 4 is as follows: Namely, at the bottom of a bobbin, which is not illustrated, the first short-circuit ring 4 made of a planar, ring-shaped, conducting thin film is placed, and an insulated, covered copper-wire 5 is wound once by a winding machine to make a layer, forming a planar spiral, which is not illustrated. Then at the coil layer 11, which was just wound, the second short-circuit ring 4 made of a planar, ring-shaped, conducting thin film is placed. Likewise, at the coil layer 12, which was already wound, the third short-circuit ring 4 made of a planar, ring-shaped, conducting thin film is placed. This procedure is repeated to place a short-circuit ring 4 made of a planar, ring-shaped, conducting thin film in every inter-layer space, that is the space between a couple of neighboring layers, until a short-circuit ring 4 of conducting thin film is placed on the last coil layer 25.

It is possible to ground the short-circuit rings 4 of conducting thin film positioned in-between every layer as well as the short-circuit rings 4 of conducting thin film positioned at top- and bottom surfaces of each coil. Grounding makes the short-circuit rings function as shield plates.

In the first embodiment of the present invention, each short-circuit ring 4 of this metallic thin film with a large surface area functions in principle in the same way as former isolation transformers of short-circuit-ring type depicted in FIG. 9. Namely, through this short-circuit ring 4 of conducting thin film flows the current induced by fundamental-wave current flowing through the primary coil, its higher harmonics, and some high-frequency noise from external sources. In this case, as the high-frequency components flow essentially at the surface of the conductor only owing to the skin effect, they flow around the short-circuit ring, even if the ring is thin. Therefore, being effectively attenuated by the resistivity of the short-circuit ring 4 of conducting thin film, it is hard for the high-frequency noise to flow from the primary coil to the secondary coil. At the same time, for the resistivity of each short-circuit ring functions as a resistance commonly inserted into of the resonance circuits, the resistivity of the short-circuit rings has the effect of dramatically reducing the amplitudes of resonances, which are distributed in the form of a number of infinitesimally small irregularly present resonance circuits due to complex combinations of capacitance and leakage inductances irregularly distributed in the coils. Meanwhile, the currents induced by the fundamental wave, which are low-frequency components, are reduced in proportion to the cross sectional area of the conducting thin film of the short-circuit ring 4. However, as the short-circuit ring is made of a thin film of thickness of 7 $\mu$m, its cross section is small albeit its width. Therefore, the induced currents of fundamental-wave component that flow through the short-circuit ring are extremely small. As a consequence, in isolation transformers of short-circuit ring type, which are the first embodiment, the troubles caused by high-frequency noise components could be eliminated or excluded, while keeping the loss of the fundamental-wave component negligibly small.

Though the number of short-circuit ring 4 of conducting thin film used in existing isolation transformers of short-circuit-ring type is one, as many as twelve short-circuit rings 4 are adopted in the first embodiment of the present invention. And these numerous short-circuit rings 4 are inserted in-between every layer that forms coils. For this reason, a tertiary coil is effectively formed adjacent to each coil layer; intensifying the electromagnetic interaction between each coil and its neighboring tertiary coil, i.e., a short-circuit ring 4 of conducting thin film. That is why the short-circuit rings 4 may eliminate or exclude the troubles caused by high-frequency noise components more effectively.

Moreover, in the existing isolation transformers shown in FIG. 9, in which a single short-circuit ring 4 is used, the distance from the short-circuit ring of conducting thin film to each coil layer is different, and therefore the effect due to conducting thin film of eliminating or excluding the troubles caused by high-frequency noise components does not reach all parts of a coil on the average. In contrast, in the isolation transformer of the first embodiment, in which a short-circuit ring 4 of conducting thin film is positioned tightly adjacent to every coil layer, it is possible for the effect of eliminating or excluding the troubles caused by high-frequency noise components due to conducting thin film to reach all parts of a coil on the average.

For this reason, the isolation transformer of the first embodiment, in which a short-circuit ring 4 of conducting thin film is placed in each inter-coil-layer space, shows smaller amplitudes of attenuation characteristic curve with crests and troughs of various sizes more averaged and contracted than previous ones. Consequently, in comparison with the existing isolation transformers of short-circuit-ring type with a wide short-circuit ring 4 of conducting thin film covering each surface of primary- and secondary coils or with the isolation transformers of short-circuit-ring type with a wide short-circuit ring of conducting thin film positioned between and in the vicinity of primary- and secondary coils, the isolation transformers of short-circuit-ring type in the first embodiment, have flatter characteristic curves of noise attenuation rates overall, eliminating or filtering high-frequency noise components much more effectively. In this way, the isolation transformers of short-circuit-type keep high noise-attenuation rates in the high-frequency range exceeding a few MHz, particularly in the range over 10 MHz, while sufficiently suppressing each amplitude of the irregular saw-tooth wave comprised by a series of crests and troughs of various sizes.

It is possible to implement an isolation transformer of short-circuit-ring type, which is shown in the first embodiment with a short-circuit ring 4 distributed to each inter-coil-layer space as shown in FIG. 1, modifying it in various ways as shown in FIGS. 3 and 4.

Depicted in FIG. 3 is an isolation transformer with distributing short-circuit rings 4 of conducting thin film to selected inter-coil-layer spaces instead of each one. Namely, in the primary coil 1, which is comprised by six planar, spiral, coil layers 11, 12, 13, 14, 15 and 16, a planar, short-circuit ring 4 of conducting thin film is inserted into the space between coil layers 11 and 12, 13 and 14, 15 and 16, respectively. Likewise, in the secondary coil 2, which is comprised by six planar, spiral, coil layers 21, 22, 23, 24, 25 and 26, a short-circuit ring 4 of conducting thin film is inserted into the space between coil layers 21 and 22, 23 and 24, 25 and 26, respectively. Therefore, in the isolation transformer of short-circuit-ring type shown in FIG. 3, there are in all six short-circuit rings 4 of conducting thin film used with three of them positioned in the primary coil and three others in the secondary coil.

Depicted in FIG. 4 is an isolation transformer to which this invention is applied with cylindrically-wound, cylindrical coil-layers instead of planar, spiral coil-layers; the cylindrical coils are multi-layer, multi-winding coils that are comprised by plural, cylindrical coil layers with their inner radii being different by the diameter of the wire. Namely, in the primary coil 1, which is comprised by five cylindrical, coil layers 11, 12, 13, 14, and 15, a cylindrical, short-circuit ring 4 of conducting thin film is inserted into each inter-coil-layer space, respectively. Furthermore, a cylindrical short-circuit ring 4 of conducting thin film is placed at the inner surface of the coil layer 11 as well as at the outer surface of the coil layer 15, respectively. Likewise, in the secondary coil 2, which is comprised by five cylindrical, coil layers 21, 22, 23, 24, and 25, a cylindrical, short-circuit ring 4 of conducting thin film is inserted into each inter-coil-layer space, respectively. Furthermore, a cylindrical short-circuit ring 4 of conducting thin film is placed at the inner surface of the coil layer 21 as well as at the outer surface of the coil layer 25, respectively. Therefore, in the isolation transformer of short-circuit-ring type shown in FIG. 4, there are in all twelve cylindrical, short-circuit rings 4 of conducting thin film used with six of them positioned in the primary coil and six others in the secondary coil.

The method to position a short-circuit ring 4 of conducting thin film into each space between coil layers in an isolation transformer of short-circuit-ring type shown in FIG. 4 is as follows: Namely, at the outer surface of a bobbin [not illustrated] the first cylindrical, short-circuit ring 4 of conducting thin film is placed, and an insulated, covered copper-wire 5 is wound once cylindrically by a winding machine [not illustrated] to complete a single layer. Then at the coil layer 11, which was just wound, the second cylindrical, short-circuit ring 4 of conducting thin film is placed. Likewise, at the cylindrical coil layer 12, which was already wound, the third cylindrical, short-circuit ring 4 of conducting thin film is placed. This procedure is repeated to place a short-circuit ring 4 of conducting thin film in every inter-layer space, that is the space between a couple of neighboring layers, until the last, cylindrical, short-circuit ring 4 of conducting thin film is placed at the outer surface of the last cylindrical coil layer 25. A cylindrical, short-circuit ring 4 can be easily fabricated by winding once a conducting thin film with a specific width around a cylindrical coil layer.

The isolation transformer of short-circuit-type shown in FIG. 3, in which circular, short-circuit rings are inserted into some spaces between selected, spiral, coil-layers only, and the isolation transformers of short-circuit-type shown in FIG. 4, in which a cylindrical, short-circuit ring is inserted into each space in-between a couple of neighboring, cylindrical coil-layers, have attenuation rates of high-frequency noise almost as effective as those of the isolation transformer of short-circuit-ring type shown in FIG. 1. However, the efficiency of the former transformers is somewhat less than the latter because of the smaller number of short-circuit rings used in the former transformers. Meanwhile, in comparison with the conventional isolation transformers of short-circuit-ring type or the isolation transformers of short-circuit-ring type with a wide short-circuit ring of a conducting thin film covering each surface of primary- and secondary coils, both of the isolation transformers of short-circuit-ring type shown in FIG. 3 and the isolation transformers of short-circuit-ring type shown in FIG. 4 have flatter overall characteristic curves of noise attenuation with each amplitude of the characteristic curves of attenuation rates averaged and contracted, eliminating or filtering high-frequency noise components much more effectively.

In this way, the isolation transformers of short-circuit-type depicted in FIGS. 3 and 4 keep high noise-attenuation rates in the high-frequency range exceeding a few MHz, particularly in the range over 10 MHz, while sufficiently suppressing each amplitude of the characteristic curve, which is an irregular saw-tooth wave comprised by a series of crests and troughs of various sizes. Moreover, the isolation transformers shown in FIG. 4 has an advantage in the maneuvability in winding process over the ones shown in FIG. 1.

Next, the second embodiment of the present invention will be explained. FIG. 7 depicts a cross section of an isolation transformer of the short-circuit-ring type, which is the second embodiment with its bobbin and core omitted and with much reduced numbers of windings and layers for easier comprehension. FIG. 8 depicts a magnified part of FIG. 7. As shown in FIG. 8, the insulated, covered, copper-wire 6 is fabricated with a copper-wire 6*a* covered with an insulated cover 6*b*; the insulated cover 6*b* is further covered with a conducting thin film 6*c*. The thickness of this insulated, covered, copper-wire is approximately equal to or less than the skin depth of the induced current generated by the skin effect in the high-frequency range, in which resonances should be suppressed.

This insulated, covered, copper-wire 6 is fabricated, coating metal such as aluminum by means of vacuum evaporation over a general insulated, covered, copper-wire, which has an insulated cover 6*b* such as enamel placed over a copper-wire 6*a*. In the multi-layer, multi-winding coil fabricated by winding the insulated, covered, copper-wire 6, as the surfaces of neighboring conducting thin films are tightly attached to each other, each neighboring coil layers sandwich a metallic thin film extremely tightly.

The primary coil is a ring-type coil, in which this insulated, covered, copper-wire 6 is wound with many (N1) layers and many (M1) windings. Likewise, the secondary coil 2 is also a ring-type coil, in which an insulated, covered, copper-wire 6 is wound with many (N2) layers and many (M2) windings. For example, a transformer with output 10VA for a fundamental wave with voltage 22V has 156 as M1, 166 as M2 as well as 13 as N1 and 14 as N2, respectively.

As shown in FIG. 6, the core that forms a magnetic path between the primary coil 1 and the secondary coil 2, is a general one manufactured by stacking together of pieces of type E core and pieces of type E core of specified dimensions to specified thickness after stamping them out of an isotropic silicon steel sheet of thickness of 0.5 mm.

In the second embodiment of the present invention, which is comprised by the primary- and secondary coils with multi-layers and multi-windings wound by insulated, covered, copper-wires 6, conducting thin films 6*c* at surfaces of neighboring wires closely contact each other, most effectively sandwiching each coil-layer by the conducting thin films 6*c*; thus, it collectively forms an isolation transformer of short-circuit-ring type, which is at least equivalent to the one manufactured by positioning a short-circuit ring of planar, conducting, thin film to every space in-between planar, spiral, coil layers, and simultaneously by positioning a short-circuit ring of cylindrical, conducting, thin film to every space in-between cylindrical, coil layers. In other words, the isolation transformer of short-circuit-ring type in the second embodiment of this invention, which is presented in FIG. 7, is equivalent at least to the combination of the two isolation transformers of short-circuit-ring type in the second embodiment depicted in FIGS. 1 and 4.

In this way, in the isolation transformer of the second embodiment, in which a short-circuit-ring of conducting thin film 6*c* is positioned closely adjacent to each other, the closely attached, neighboring, short-circuit rings of conducting thin film 6*c* collectively and simultaneously form planar, short-circuit rings of conducting thin film with wide surface areas inserted in-between every planar, coil layer as well as cylindrical short-circuit rings of conducting thin film with wide surface areas inserted in-between every cylindrical coil-layer. Subsequently, as the electromagnetic couplings between each coil layer and neighboring short-circuit rings of conducting thin film become the strongest, elimination or exclusion of the troubles caused by high-frequency noise components can be performed more effectively by short-circuit rings of conducting thin film than in the first embodiment. Moreover, as it is equivalent to positioning each short-circuit ring of conducting thin film at the closest possible distance from each coil layer, in this isolation transformers of short-circuit-ring type the elimination or exclusion effects due to these equivalent short-circuit rings reach to every part of coils in a more averaged manner.

Consequently, in the second embodiment each amplitude of noise attenuation characteristic curve with a series of crests and troughs of various sizes is further averaged and contracted in comparison with the first embodiment. As a result, in comparison with the conventional isolation transformers of short-circuit-ring type with a wide short-circuit ring of conducting thin film covering each surface of primary- and secondary coils and of the conventional isolation transformers of short-circuit-ring type with a wide short-circuit ring of conducting thin film positioned between and in the close vicinity of primary- and secondary coils the isolation transformers of short-circuit-ring type in the second embodiment have larger noise-attenuation rates in the high-frequency range exceeding a few MHz, particularly in the range over 10 MHz, while sufficiently suppressing each amplitude of the irregular saw-tooth wave comprised by a series of crests and troughs of various sizes.

The first and second examples in which the present invention were implemented to isolation transformers comprised by a multi-layer, multi-winding primary coil, a multi-layer, multi-winding secondary coil, and a magnetic path of each coil have been explained in detail above. However, this invention is of course not limited to these examples of implementation. Though the short-circuit rings of conducting thin film are applied to both of the multi-layer, multi-winding primary- and secondary coils in the above examples, they may be applied to either one. Similarly, though the insulated, covered, copper-wires made by coating some copper-wires with insulated films, and further coating the insulated surfaces with conducting thin films are used in both of the multi-layer, multi-winding primary- and secondary coils in the above examples, they may be used in either one.

The configuration of the wound-up, primary- and secondary coils are not limited to circular nor rectangular ones, and coils may take any other geometry. The core that forms a magnetic path between the primary- and secondary coil is not limited to the ones manufactured by stacking together pieces of type E core and pieces of type I core shown in FIG. 6, and may be a cut core or other types of cores. The isolation transformers related to the present invention may eliminate or filter high-frequency noise components even if they are used in combination with ordinary means for filtering.

Owing to the present invention the isolation transformers of short-circuit-type with high noise attenuation rates in the high-frequency range exceeding a few MHz, and particularly above 10 MHz, while sufficiently suppressing each amplitude of the irregular, saw-tooth shaped waves with a series of crests and troughs of various sizes have been provided.

Namely, the isolation transformers of short-circuit-ring type now have flatter overall characteristic curves of noise attenuation with each amplitude of the characteristic curves of attenuation rates averaged and contracted, eliminating or filtering high-frequency noise components much more effectively in the high-frequency range exceeding a few MHz, and particularly above 10 MHz.

Consequently, isolation transformers with extremely high reliability have been provided in comparison with the conventional isolation transformers of short-circuit-ring type with a wide short-circuit ring of conducting thin film covering each surface of primary- and secondary coils and of the conventional isolation transformers of short-circuit-ring type with a wide short-circuit ring of a conducting thin film positioned between and in the vicinity of primary- and secondary coils.

What is claimed is:

1. An isolation transformer comprising:

a multi-layer, multi-winding primary coil fabricated by stacking coil layers formed by winding an insulated, covered, copper wire;

a multi-layer, multi-winding secondary coil fabricated by stacking coil layers formed by winding an insulated, covered copper wire;

a core that forms a magnetic path between the primary coil and the secondary coil; and a plurality of short-circuit rings made of conducting thin films sandwiched between the coil layers of at least one of the primary and secondary coils.

2. The isolation transformer of claim 1, wherein the short-circuit rings are sandwiched between each of the coil layers.

3. The isolation transformer of claim 1, wherein the short-circuit rings are sandwiched between selected coil layers.

4. The isolation transformer of claim 1, wherein the coil layers of the primary and the secondary coils are sheet-type coil layers and are formed by winding the copper wire spirally.

5. The isolation transformer of claim 4, wherein the short-circuit rings are sandwiched between each of the coil layers.

6. The isolation transformer of claim 4, wherein the short-circuit rings are sandwiched between selected coil layers.

7. The isolation transformer of claim 1, wherein the coil layers of the primary and the secondary coils are cylinder-type coil layers and are formed by winding the copper wire cylindrically.

8. The isolation transformer of claim 4, wherein the short-circuit rings are sandwiched between each of the coil layers.

9. The isolation transformer of claim 4, wherein the short-circuit rings are sandwiched between selected coil layers.

10. An isolation transformer, comprising:

a multi-layer, multi-winding primary coil fabricated by stacking coil layers formed by winding an insulated, covered copper wire;

a multi-layer, multi-winding secondary coil fabricated by stacking coil layers formed by winding an insulated, covered copper wire;

a core forming a magnetic path between the primary coil and the secondary coil; and wherein the copper wire forming at least one of the primary and secondary coils is coated with a thin conducting film.

11. The isolation transformer of claim 10, wherein said primary and secondary coils are not concentrically wound.

12. The isolation transformer of claim 1, wherein said primary and secondary coils are not concentrically wound.

* * * * *